US011037508B1

(12) United States Patent
Li et al.

(10) Patent No.: US 11,037,508 B1
(45) Date of Patent: Jun. 15, 2021

(54) PIXEL DRIVING CIRCUIT, DISPLAY PANEL AND METHODS FOR DRIVING THE SAME

(71) Applicants: Chengdu BOE Optoelectronics Technology Co., Ltd., Chengdu (CN); BOE Technology Group Co., Ltd., Beijing (CN)

(72) Inventors: Yang Li, Beijing (CN); Yunzhi Wang, Beijing (CN); Yun Luo, Beijing (CN); Xiaoming Feng, Beijing (CN); Minyang Deng, Beijing (CN)

(73) Assignees: CHENGDU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/857,369

(22) Filed: Apr. 24, 2020

(30) Foreign Application Priority Data

Nov. 28, 2019 (CN) ..... 201911189265.X

(51) Int. Cl.
*G09G 3/3283* (2016.01)

(52) U.S. Cl.
CPC ..... *G09G 3/3283* (2013.01); *G09G 2310/066* (2013.01); *G09G 2320/0252* (2013.01)

(58) Field of Classification Search
CPC ..... G09G 3/3283; G09G 2320/0252; G09G 2310/066
See application file for complete search history.

(56) References Cited

U.S. PATENT DOCUMENTS

| | | | |
|---|---|---|---|
| 8,581,271 | B2 | 11/2013 | Shikina et al. |
| 9,349,321 | B2 | 5/2016 | Chen |
| 9,799,270 | B2 | 10/2017 | Li et al. |
| 10,068,950 | B2 | 9/2018 | Yang |

(Continued)

FOREIGN PATENT DOCUMENTS

| | | | |
|---|---|---|---|
| CN | 103474025 | A | 12/2013 |
| CN | 104112427 | A | 10/2014 |

(Continued)

OTHER PUBLICATIONS

First Office Action, including Search Report, for Chinese Patent Application No. 201911189265.X, dated Aug. 31, 2020, 21 pages.

*Primary Examiner* — Carolyn R Edwards
(74) *Attorney, Agent, or Firm* — Westman, Champlin & Koehler, P.A.

(57) ABSTRACT

The present disclosure provides a pixel driving circuit, a display panel and methods for driving the same. The pixel driving circuit includes: at least two driving sub-circuits, each configured to generate driving current based on a compensated data signal; at least two light-emitting control sub-circuits coupled to the at least two driving sub-circuits respectively, each of the at least two light-emitting control sub-circuits is configured to output driving current generated by one of the at least two driving sub-circuit coupled thereto; a writing control sub-circuit electrically coupled to the at least two driving sub-circuits and a data writing sub-circuit; and the data writing sub-circuit configured to compensate for a data signal and write the compensated data signal into the at least two driving sub-circuits sequentially under control of the writing control sub-circuit.

14 Claims, 7 Drawing Sheets

(56) References Cited

U.S. PATENT DOCUMENTS

Figure 1:
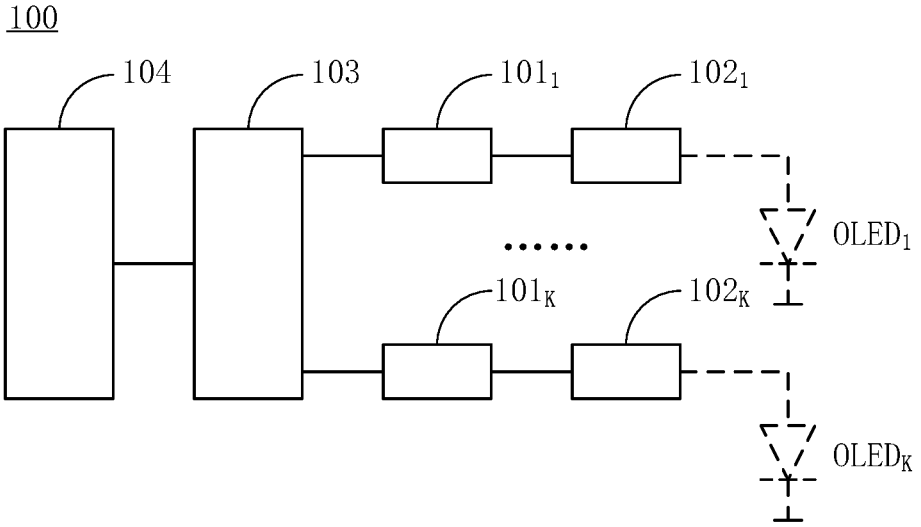

| | | | | |
|---|---|---|---|---|
| 10,679,556 | B2 | 6/2020 | Yang et al. | |
| 2011/0284881 | A1 | 11/2011 | Shikina et al. | |
| 2015/0213761 | A1* | 7/2015 | Chen | G09G 3/3291 345/77 |
| 2016/0204165 | A1* | 7/2016 | Yang | G09G 3/3225 345/174 |
| 2017/0193906 | A1 | 7/2017 | Li et al. | |
| 2019/0325823 | A1 | 10/2019 | Yang et al. | |

FOREIGN PATENT DOCUMENTS

| | | | |
|---|---|---|---|
| CN | 105427798 | A | 3/2016 |
| CN | 107170408 | A | 9/2017 |
| CN | 108877664 | A | 11/2018 |
| CN | 110400542 | A | 11/2019 |
| WO | 2011145174 | A1 | 11/2011 |

* cited by examiner

PIXEL DRIVING CIRCUIT, DISPLAY PANEL AND METHODS FOR DRIVING THE SAME

CROSS-REFERENCE TO RELATED APPLICATION(S)

This application claims priority to the Chinese Patent Application No. 201911189265.X filed on Nov. 28, 2019, which is incorporated herein by reference in its entirety.

TECHNICAL FIELD

The present disclosure relates to the field of display technology, and more particularly, to a pixel driving circuit, a display panel, and methods for driving the same.

BACKGROUND

Organic Light-emitting Diodes (OLEDs) have advantages such as self-emission, wide viewing angles, high contrast, low power consumption, and fast response speeds etc., and therefore have been widely used and developed. When an OLED display apparatus is used, it needs to compensate for pixels during use to improve their display performance. However, since a compensation circuit has a complicated structure, it needs to occupy a large layout space, thereby limiting the improvement of a resolution of the pixels of the OLED display apparatus.

SUMMARY

The present disclosure provides a pixel driving circuit, a display panel, and methods for driving the same.

According to an aspect of the present disclosure, there is provided a pixel driving circuit, comprising:

at least two driving sub-circuits, each configured to generate driving current based on a compensated data signal;

at least two light-emitting control sub-circuits coupled to the at least two driving sub-circuits respectively, each of the at least two light-emitting control sub-circuits is configured to output driving current generated by one of the at least two driving sub-circuits coupled thereto;

a writing control sub-circuit electrically coupled to the at least two driving sub-circuits and a data writing sub-circuit; and the data writing sub-circuit configured to compensate for a data signal and write the compensated data signal into the respective at least two driving sub-circuits sequentially under control of the writing control sub-circuit.

In some embodiments, the data writing sub-circuit comprises:

a first transistor having a gate electrically coupled to receive a first reset signal, a first electrode electrically coupled to receive a first initialization signal, and a second electrode electrically coupled to a gate of a second transistor and a first electrode of the second transistor;

the second transistor having a second electrode electrically coupled to a first electrode of a third transistor; and the third transistor having a gate electrically coupled to receive a scanning signal, and a second electrode electrically coupled to receive the data signal.

In some embodiments, the writing control sub-circuit comprises:

at least two switching sub-circuits electrically coupled to the at least two driving sub-circuits respectively, each switching sub-circuit is configured to receive a writing control signal and write the compensated data signal generated by the data writing sub-circuit into one of the at least two driving sub-circuit coupled thereto under control of the writing control signal.

In some embodiments, each of the at least two switching sub-circuits comprises:

a fourth transistor having a gate electrically coupled to receive the writing control signal, a first electrode electrically coupled to the data writing sub-circuit to receive the compensated data signal, and a second electrode electrically coupled to one of the at least two driving sub-circuits.

In some embodiments, each of the at least two driving sub-circuits comprises:

a fifth transistor having a gate electrically coupled to one of the at least two switching sub-circuits, a first electrode electrically coupled to one of the at least two light-emitting control sub-circuits, and a second electrode electrically coupled to receive a first voltage; and a storage capacitor having a first terminal electrically coupled to the gate of the fifth transistor, and a second terminal electrically coupled to receive the first voltage.

In some embodiments, each of the at least two light-emitting control sub-circuits comprises:

a sixth transistor having a gate electrically coupled to receive a light-emitting control signal, a first electrode electrically coupled to output the driving current, and a second electrode electrically coupled to the first electrode of the fifth transistor.

In some embodiments, each of the light-emitting control sub-circuits further comprises:

a seventh transistor having a gate electrically coupled to receive a second reset signal, a first electrode electrically coupled to receive a second initialization signal, and a second electrode electrically coupled to the first electrode of the sixth transistor.

In some embodiments, a difference between a threshold voltage of the second transistor and a threshold voltage of a fifth transistor in each driving sub-circuit which is used as a driving transistor is within a preset first threshold range.

In some embodiments, a difference between a temperature drift amount of the threshold voltage of the second transistor and a temperature drift amount of the threshold voltage of the fifth transistor in each driving sub-circuit is within a preset second threshold range.

In some embodiments, an absolute value of the difference between the threshold voltage of the second transistor and the threshold voltage of the fifth transistor is less than or equal to 0.01V.

In some embodiments, an absolute value of the difference between the temperature drift amount of the threshold voltage of the second transistor and the temperature drift amount of the threshold voltage of the fifth transistor is equal to or less than 0.01V.

In some embodiments, the at least two driving sub-circuits comprise a first driving sub-circuit and a second driving sub-circuit, wherein the first driving sub-circuit is configured to generate first driving current based on the compensated data signal, and the second driving sub-circuit is configured to generate second driving current based on the compensated data signal; and the at least two light-emitting control sub-circuits comprise a first light-emitting control sub-circuit and a second light-emitting control sub-circuit, wherein the first light-emitting control sub-circuit is coupled to the first driving sub-circuit and is configured to output the first driving current generated by the first driving sub-circuit under control of a first light-emitting control signal, and the second light-emitting control sub-circuit is coupled to the second driving sub-circuit, and is configured to output the second driving current generated by the second driving sub-circuit under control of a second light-emitting control signal.

In some embodiments, the writing control sub-circuit comprises:

a first switching sub-circuit electrically coupled between the first driving sub-circuit and the data writing sub-circuit, and configured to receive a first writing control signal, and provide the compensated data signal generated by the data writing sub-circuit to the first driving sub-circuit under control of the first writing control signal; and a second switching sub-circuit electrically coupled between the second driving sub-circuit and the data writing sub-circuit, and configured to receive a second writing control signal, and provide the compensated data signal generated by the data writing sub-circuit to the second driving sub-circuit under control of the second writing control signal.

In some embodiments, the data writing sub-circuit is configured to compensate for a first data signal and write the compensated first data signal into the first driving sub-circuit, and compensate for a second data signal and write the compensated second data signal into the second driving sub-circuit, under control of the writing control sub-circuit.

According to another aspect of the present disclosure, there is provided a display panel comprising a plurality of pixel units arranged in an array, each pixel unit comprising:

the pixel driving circuit described above; and at least two light-emitting elements electrically coupled in one-to-one correspondence with the at least two driving sub-circuits of the pixel driving circuit.

In some embodiments, the array is an M×N array, wherein M and N are both integers greater than 1;

pixel driving circuits of an $i^{th}$ row of pixel units are coupled to receive an $i^{th}$ scanning signal, wherein i is an integer, and $1 \le i \le M$; and pixel driving circuits of a $j^{th}$ column of pixel units are coupled to receive a $j^{th}$ data signal, wherein j is an integer, and $1 \le j \le N$.

According to yet another aspect of the present disclosure, there is provided a method for driving the pixel driving circuit described above, comprising:

during a first period, compensating for, by the data writing sub-circuit, a $k^{th}$ data signal and writing the compensated $k^{th}$ data signal into a $k^{th}$ driving sub-circuit of the pixel driving circuit under control of the writing control sub-circuit;

during a second period, outputting, by a $k^{th}$ light-emitting control sub-circuit, $k^{th}$ driving current generated by the $k^{th}$ driving sub-circuit;

during a third period, compensating for, by the data writing sub-circuit, a $(k+1)^{th}$ data signal and writing the compensated $(k+1)^{th}$ data signal into a $(k+1)^{th}$ driving sub-circuit of the pixel driving circuit under control of the writing control sub-circuit; and during a fourth period, outputting, by a $(k+1)^{th}$ light-emitting control sub-circuit, $(k+1)^{th}$ driving current generated by the $(k+1)^{th}$ driving sub-circuit, wherein k is an integer, and $1 \le k \le K-1$, where K represents a number of driving sub-circuits of the pixel driving circuit, and is an integer greater than 1.

According to still another aspect of the present disclosure, there is provided a method for driving the display panel described above, comprising: for each pixel unit, during a first period, writing, by a data writing sub-circuit of a pixel driving circuit of the pixel unit, a compensated data signal for a $k^{th}$ light-emitting element of the pixel unit into a $k^{th}$ driving sub-circuit of the pixel driving circuit;

during a second period, causing the $k^{th}$ light-emitting element to emit light using the compensated data signal;

during a third period, writing, by the data writing sub-circuit of the pixel driving circuit, a compensated data signal for a $(k+1)^{th}$ light-emitting element of the pixel unit into a $(k+1)^{th}$ driving sub-circuit of the pixel driving circuit; and during a fourth period, causing the $(k+1)^{th}$ light-emitting element to emit light using the compensated data signal, wherein k is an integer and $1 \le k \le K-1$, where K represents a number of driving sub-circuits of the pixel driving circuit in the pixel unit, and is an integer greater than 1.

BRIEF DESCRIPTION OF THE ACCOMPANYING DRAWINGS

Figure 2:
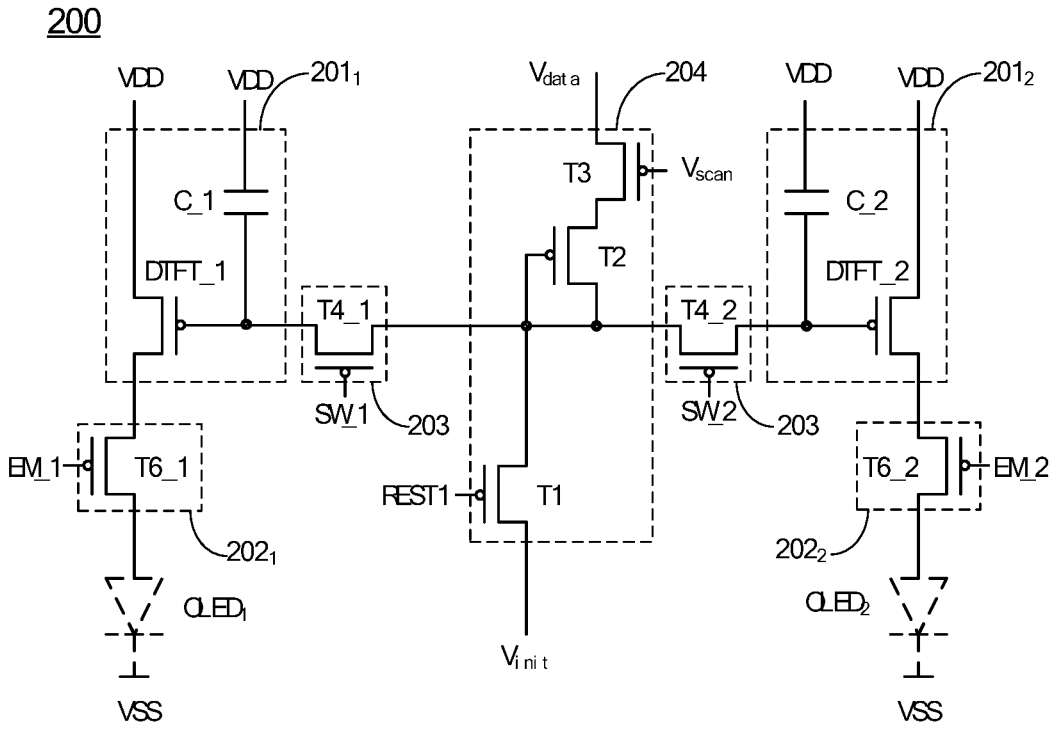
Figure 3:
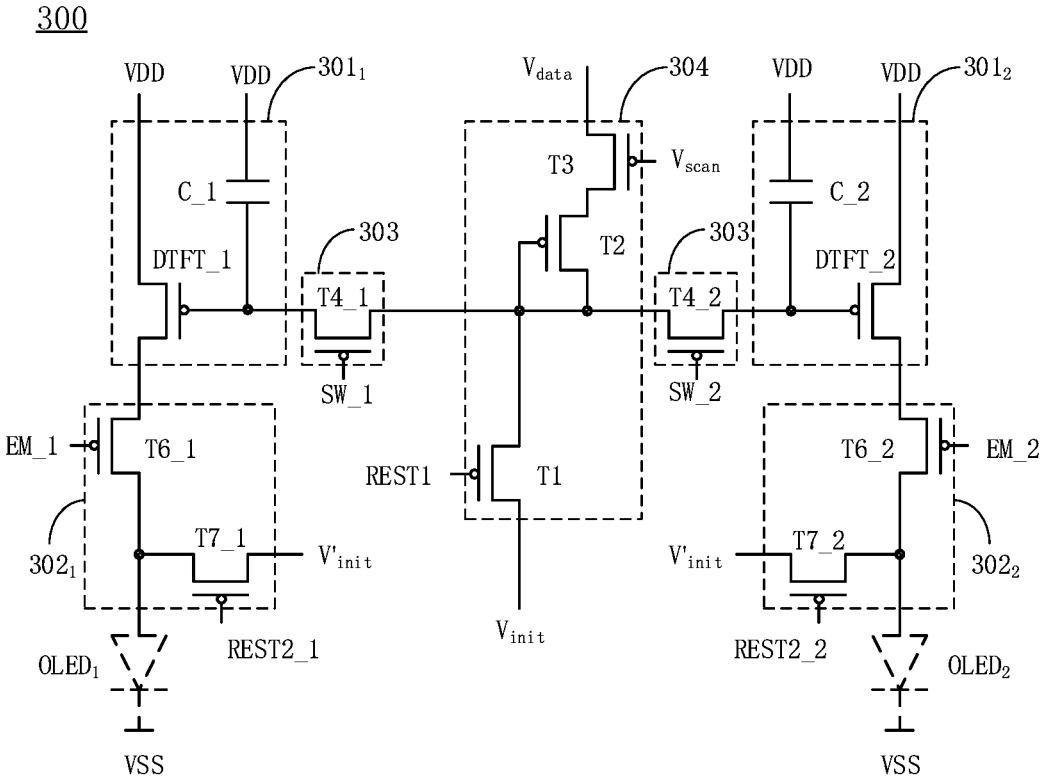
Figure 4:
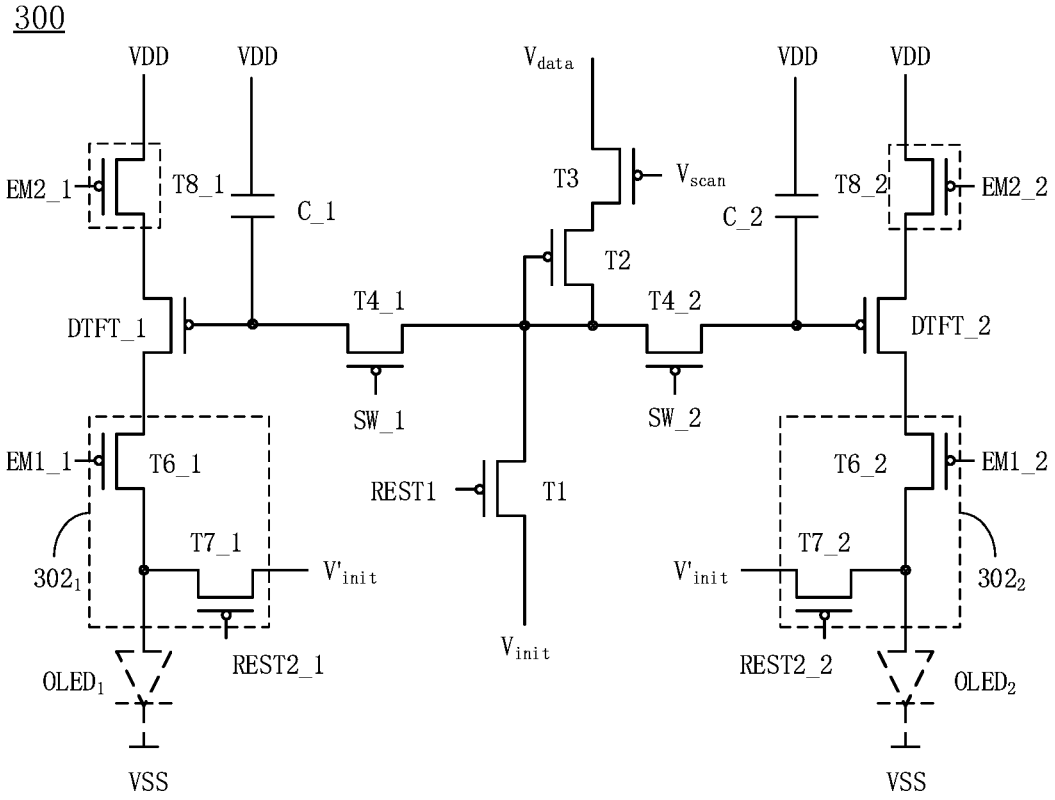
Figure 5:
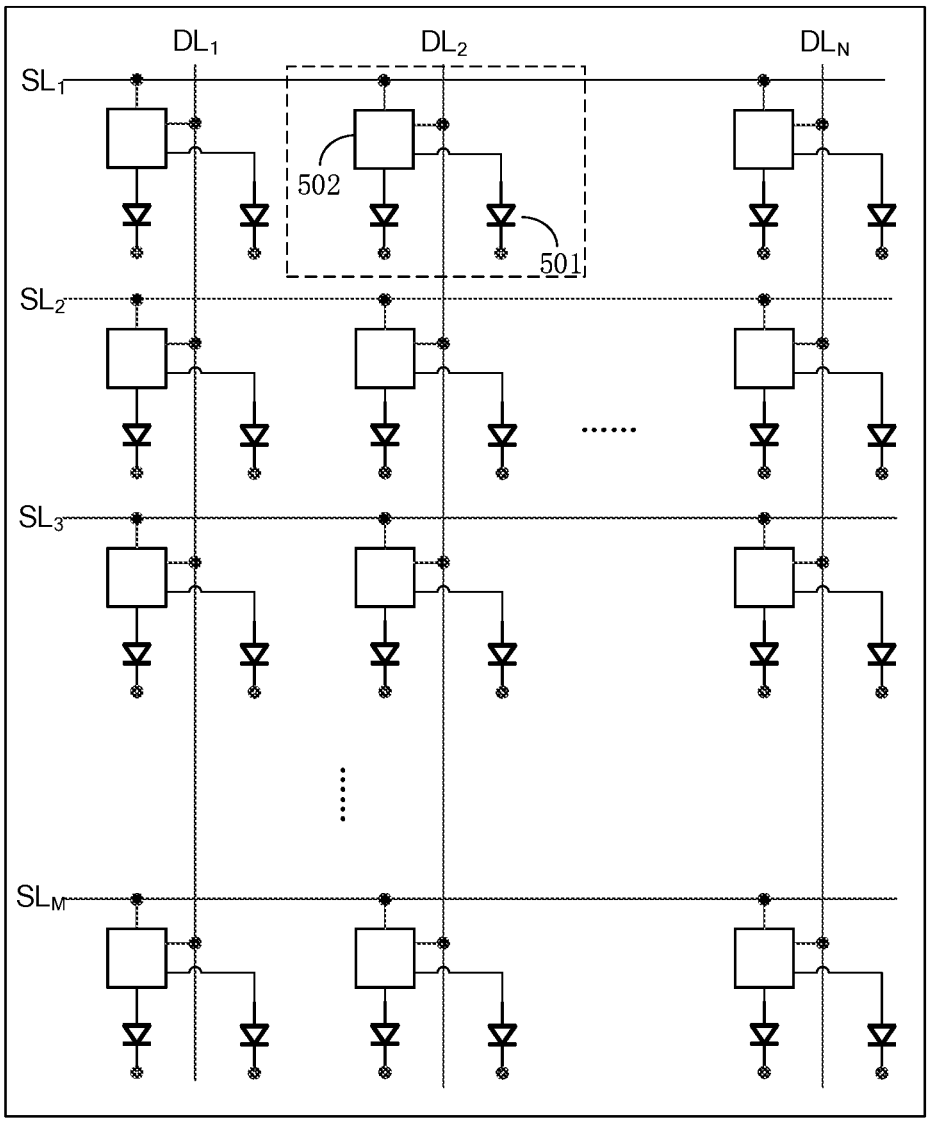
Figure 6:
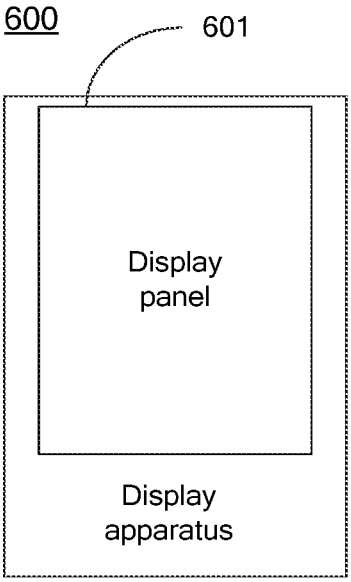
Figure 7:
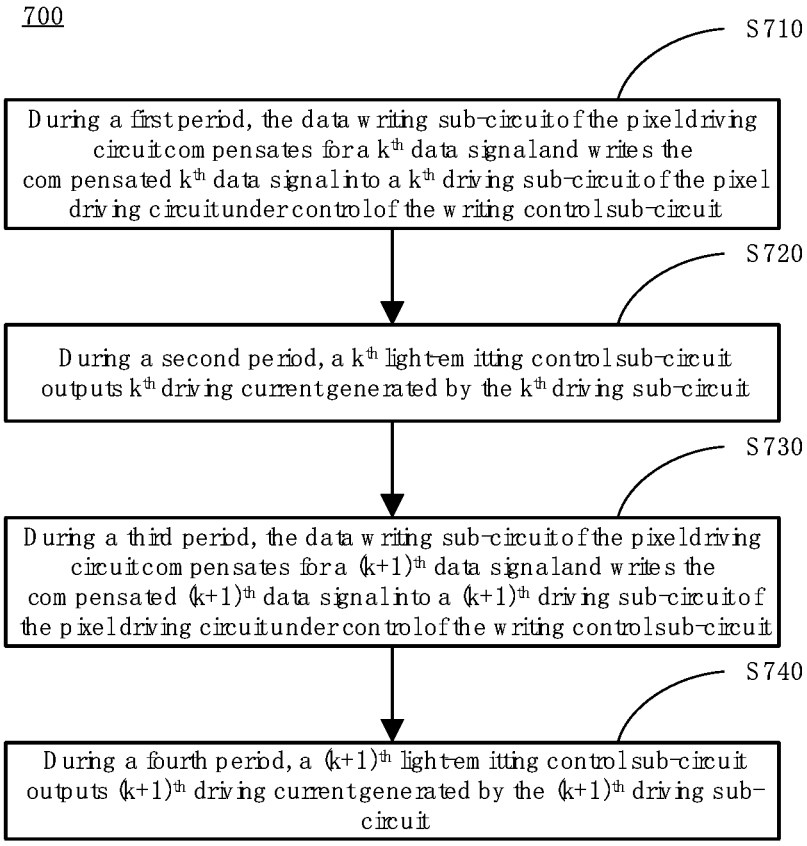
Figure 8A:
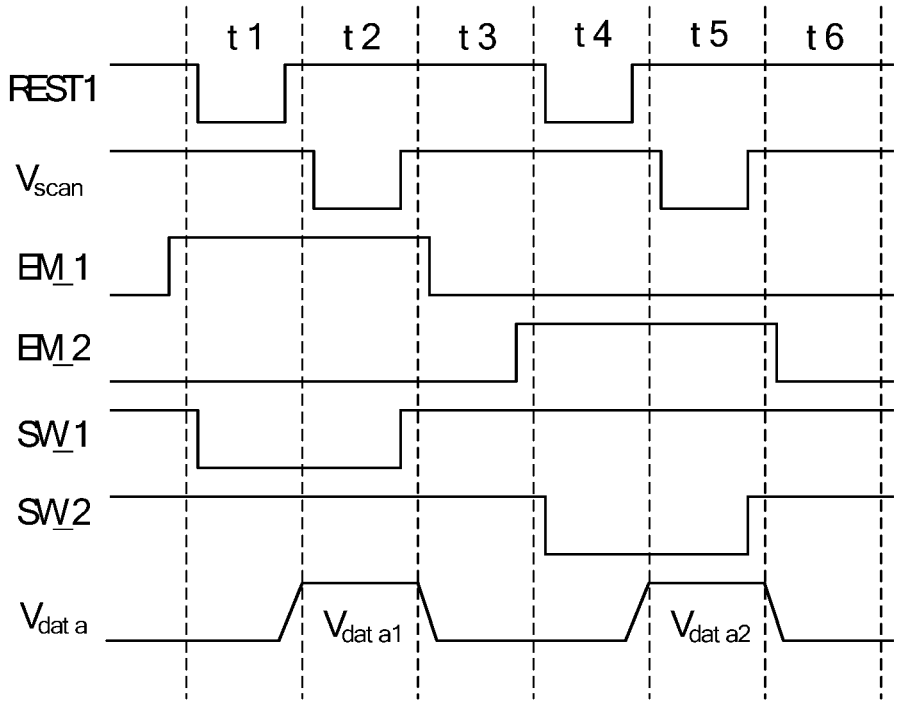
Figure 8B:
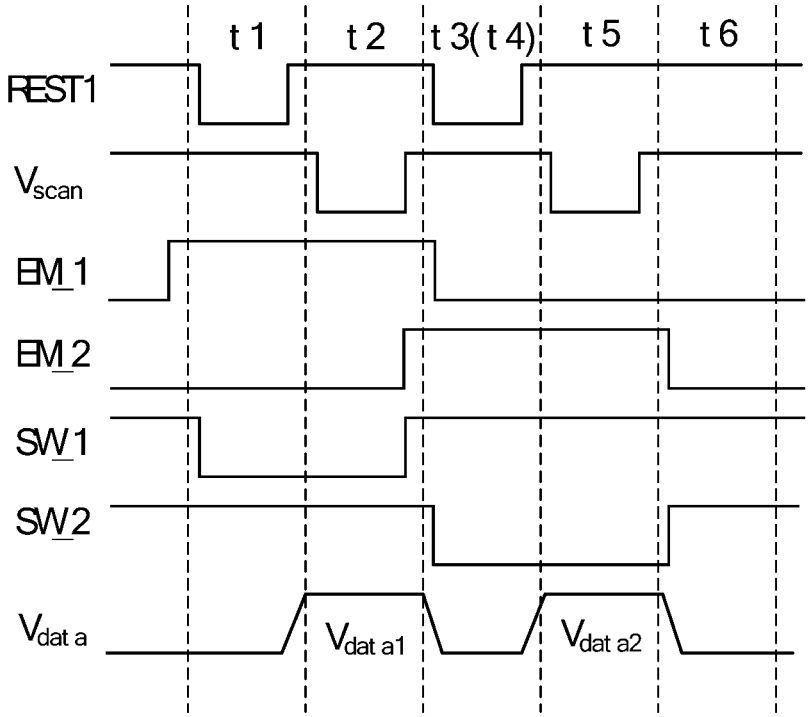

The above and other purposes, features, and advantages of the embodiments of the present disclosure will be more obvious by describing the embodiments of the present disclosure with reference to the accompanying drawings. It should be illustrated that throughout the accompanying drawings, the same elements are represented by the same or similar reference signs. In the accompanying drawings:

FIG. 1 schematically illustrates a block diagram of a pixel driving circuit according to an embodiment of the present disclosure;

FIG. 2 schematically illustrates an exemplary circuit structure of a pixel driving circuit according to an embodiment of the present disclosure;

FIG. 3 schematically illustrates another exemplary circuit structure of a pixel driving circuit according to an embodiment of the present disclosure;

FIG. 4 schematically illustrates still another exemplary circuit structure of a pixel driving circuit according to an embodiment of the present disclosure;

FIG. 5 schematically illustrates a block diagram of a display panel according to an embodiment of the present disclosure;

FIG. 6 schematically illustrates a block diagram of a display apparatus according to an embodiment of the present disclosure;

FIG. 7 schematically illustrates a flowchart of a driving method according to an embodiment of the present disclosure; and FIGS. 8A and 8B schematically illustrate timing diagrams of a driving method according to an embodiment of the present disclosure.

DETAILED DESCRIPTION

In order to make the purposes, technical solutions and advantages of the embodiments of the present disclosure more clear, the technical solutions in the embodiments of the present disclosure will be clearly and completely described below in conjunction with the accompanying drawings in the embodiments of the present disclosure. Obviously, the embodiments described are a part of the embodiments of the present disclosure instead of all the embodiments. All other embodiments obtained by those of ordinary skill in the art based on the described embodiments of the present disclosure without contributing any creative work are within the protection scope of the present disclosure. In the following description, some specific embodiments are for illustrative purposes only and are not to be construed as limiting the present disclosure, but merely examples of the embodiments of the present disclosure. The conventional structure or construction will be omitted when it may cause confusion with the understanding of the present disclosure. It should be illustrated that shapes and dimensions of components in the figures do not reflect true sizes and proportions, but only illustrate contents of the embodiments of the present disclosure.

Unless otherwise defined, technical terms or scientific terms used in the embodiments of the present disclosure should be of ordinary meanings to those skilled in the art. "First", "second" and similar words used in the embodiments of the present disclosure do not represent any order, quantity or importance, but are merely used to distinguish between different constituent parts.

Particularly, in the description of the embodiments of the present discourse, unless a source and a drain of a transistor are specified, a "first electrode" refers to a source or a drain of a switch transistor, and a "second electrode" refers to the drain or the source of the switch transistor, which will not be distinguished from each other.

Furthermore, in the description of the embodiments of the present disclosure, the term "connected to" or "connected with" may mean that two components are directly connected, or that two components are connected via one or more other components. In addition, the two components may be connected or coupled by wire or wirelessly.

The embodiments of the present disclosure provide a pixel driving circuit capable of compensating for a threshold voltage of a light-emitting element such as an OLED. The pixel driving circuit is configured to drive at least two light-emitting elements. A block diagram of the pixel driving circuit is shown in FIG. 1, and a structure of the pixel driving circuit according to the embodiment of the present disclosure will be described below with reference to FIG. 1.

As shown in FIG. 1, the pixel driving circuit 100 comprises at least two driving sub-circuits $\mathbf{101}_1, \ldots, \mathbf{101}_K$, wherein K is a natural number greater than or equal to 2. Each of the driving sub-circuits is electrically coupled to a light-emitting element. Each of the at least two driving sub-circuits $\mathbf{101}_1, \ldots, \mathbf{101}_K$ is configured to generate current (driving current) which causes respective one of the at least two light-emitting elements $OLED_1, \ldots, OLED_K$ to emit light.

In FIG. 1, in order to facilitate description of an electrical connection between the pixel driving circuit 100 and the light-emitting elements, the light-emitting elements $OLED_1, \ldots, OLED_K$ are shown in dotted lines.

In addition, in FIG. 1, the light-emitting elements are shown in a form of OLEDs, and it may be understood by those skilled in the art that the light-emitting elements may be other light-emitting elements for example current driving-type light-emitting elements, and the present disclosure is not limited thereto.

As shown in FIG. 1, the pixel driving circuit 100 may further comprise at least two light-emitting control sub-circuits $\mathbf{102}_1, \ldots, \mathbf{102}_K$, wherein K is a natural number greater than or equal to 2. Each of the light-emitting control sub-circuits is electrically coupled between a driving sub-circuit and a light-emitting element. Each of the at least two light-emitting control sub-circuits $\mathbf{102}_1, \ldots, \mathbf{102}_K$ is configured to provide current generated by the respective of the driving sub-circuits $\mathbf{101}_1, \ldots, \mathbf{101}_K$ to the respective of the light-emitting elements $OLED_1, \ldots, OLED_K$.

As shown in FIG. 1, the pixel driving circuit 100 may further comprise a writing control sub-circuit 103 and a data writing sub-circuit 104. The writing control sub-circuit 103 is electrically coupled to the driving sub-circuits $\mathbf{101}_1, \ldots, \mathbf{101}_K$ and the data writing sub-circuit 104, and is used to control the data writing sub-circuit 104 to write a compensated data signal (for example, a signal which is obtained by adding a compensation signal to a data signal) into the driving sub-circuits $\mathbf{101}_1, \ldots, \mathbf{101}_K$ sequentially.

The data writing sub-circuit 104 may write the compensated data signals for the at least two light-emitting elements $OLED_1, \ldots, OLED_K$ respectively into the at least two driving sub-circuits $\mathbf{101}_1, \ldots, \mathbf{101}_K$ sequentially under control of the writing control sub-circuit 103.

In the pixel driving circuit according to the embodiment of the present disclosure, a threshold voltage of a pixel (for example, a driving transistor of a light-emitting element (for example, an OLED) of the pixel) may be compensated. With the development of OLED display technology, the demands for driving circuits are also increasing. In a manufacturing process in the factory, due to problems such as devices, processes etc., driving circuits of pixels are inevitably uneven. For example, threshold voltages of driving transistors of different pixels have distributivity. As another example, a temperature drift due to variation of a threshold voltage of a driving transistor with temperature also varies. These problems may affect the display effect. The display effect of the OLED display apparatus may be improved by compensating for the threshold voltages of the driving transistors.

According to the embodiment shown in FIG. 1, in an actual operation, the data signal is compensated before being written into each of the writing driving sub-circuits $\mathbf{101}_1, \ldots, \mathbf{101}_K$, which may compensate for threshold voltages of the light-emitting elements $OLED_1, \ldots, OLED_K$.

In the pixel driving circuit according to the embodiment of the present disclosure, one data writing sub-circuit (for example, the data writing sub-circuit 104) may be used to compensate for the threshold voltages of the at least two light-emitting elements. The data writing sub-circuit is provided and is shared between the at least two light-emitting elements, so that the compensated data signals for the light-emitting elements are written into the driving sub-circuits sequentially, which significantly reduces sizes of the pixel driving circuits.

With the gradual miniaturization of the application of OLED display technology and users' demands for a resolution of an OLED display screen, how to increase a screen ratio, reduce peripheral wiring, and increase a resolution of pixels has become the current research and development direction. As shown in FIG. 1, in the embodiment of the present disclosure, the data writing sub-circuit 104 may be designed according to characteristics of driving transistors in the driving sub-circuits $\mathbf{101}_1, \ldots, \mathbf{101}_K$ which drive the at least two light-emitting elements $OLED_1, \ldots, OLED_K$, so that the data writing sub-circuit 104 may have a capability of data writing and compensation for the at least two light-emitting elements. Since at least two light-emitting elements may share one data writing and compensation circuit structure, wiring may be reduced, thereby reducing sizes of respective pixel units which form a display panel. Therefore, the pixel driving circuit according to the embodiment of the present disclosure may increase a screen area ratio and significantly reduce a size of the pixel driving circuit.

The embodiments of the present disclosure will be further described below in combination with specific examples.

FIG. 2 schematically illustrates an exemplary circuit structure of a pixel driving circuit according to an embodiment of the present disclosure. In this example, description is made using an arrangement configured to drive two light-emitting elements $OLED_1$ and $OLED_2$, but the present disclosure is not limited thereto. In FIG. 2, the light-emitting elements $OLED_1$ and $OLED_2$ are shown in dotted lines.

As shown in FIG. 2, the pixel driving circuit 200 comprises a first driving sub-circuit $\mathbf{201}_1$ and a second driving sub-circuit $\mathbf{201}_2$, a first light-emitting control sub-circuit $\mathbf{202}_1$ and a second light-emitting control sub-circuit $\mathbf{202}_2$, a writing control sub-circuit 203, and a data writing sub-circuit 204. The first driving sub-circuit $\mathbf{201}_1$ is electrically coupled to the first light-emitting control sub-circuit $\mathbf{202}_1$ and a part of the writing control sub-circuit 203, and is configured to provide a compensated data signal (for example, a first compensation signal and a first data signal) to the light-emitting element $OLED_1$. The second driving sub-circuit $\mathbf{201}_2$ is electrically coupled to the second light-emitting control sub-circuit $\mathbf{202}_2$ and a part of the writing control sub-circuit 203, and is configured to provide a compensated data signal (for example, a second compensation signal and a second data signal) to the light-emitting element $OLED_2$.

The light-emitting elements $OLED_1$ and $OLED_2$ may be light-emitting elements in adjacent columns. For example, the light-emitting element $OLED_1$ is in an odd-numbered $((2n-1)^{th})$ column of a matrix formed by the light-emitting elements, and the light-emitting element $OLED_2$ is in an even-numbered $((2n)^{th})$ column of the matrix formed by the light-emitting elements, wherein k is a natural number. The above two structures electrically coupled to the light-emitting elements $OLED_1$ and $OLED_2$ respectively are arranged substantially symmetrically with respect to the data writing sub-circuit 204, but the present disclosure is not limited thereto.

The data writing sub-circuit 204 is shared by the above two structures, and therefore the pixel driving circuit 200 according to the embodiment of the present disclosure may have a simplified driving circuit structure and save wiring of data lines. When 2N light-emitting elements are included in each row of an array (for example, a matrix) formed by the light-emitting elements on a display panel, only N data writing sub-circuits 204 and N data lines need to be arranged.

As shown in FIG. 2, the data writing sub-circuit 204 comprises a first transistor T1, a second transistor T2, and a third transistor T3. According to an example, the first transistor T1 has a gate electrically coupled to receive a first reset signal REST1, a first electrode electrically coupled to receive a first initialization signal $V_{init}$, and a second electrode electrically coupled to a gate and a first electrode (a drain) of the second transistor T2. The second transistor T2 has a second electrode (a source) electrically coupled to a first electrode of the third transistor T3. The third transistor T3 has a gate electrically coupled to receive a scanning signal $V_{scan}$, and a second electrode electrically coupled to receive a data signal $V_{data}$.

The first transistor T1 may be turned on under control of the first reset signal REST1 applied to the gate thereof, thereby applying the first initialization signal $V_{init}$ to the gate and the first electrode (the drain) of the second transistor T2, wherein the first initialization signal $V_{init}$ may enable the second transistor T2 to be turned on. The third transistor T3 may be turned on under control of the scanning signal $V_{scan}$ applied to the gate thereof. In a case where the second transistor T2 and the third transistor T3 are both turned on, the compensated data signals may be written into the first driving sub-circuit $\mathbf{201}_1$ and the second driving sub-circuit $\mathbf{201}_2$ respectively under control of the writing control sub-circuit 203.

In FIG. 2, the first transistor T1, the second transistor T2, and the third transistor T3 are all shown as P-type transistors, but the present disclosure is not limited thereto. In other examples, the first transistor T1, the second transistor T2, and the third transistor T3 may also be N-type transistors. Functions of the data writing sub-circuit 204 described above may be achieved by appropriately adjusting a connection relationship between the transistors and voltages of the first reset signal REST1, the first initialization signal $V_{init}$, the data signal $V_{data}$, and the scanning signal $V_{scan}$.

As shown in FIG. 2, the writing control sub-circuit 203 comprises at least two switching sub-circuits, for example, a first switching sub-circuit comprising a fourth transistor T4_1 and a second switching sub-circuit comprising a fourth transistor T4_2. In FIG. 2, the first switching sub-circuit is electrically coupled to the first driving sub-circuit $\mathbf{201}_1$ and the second switching sub-circuit is electrically coupled to the second driving sub-circuit $\mathbf{201}_2$. The first switching sub-circuit may receive a writing control signal SW_1 (a first writing control signal) and provide the compensated data signal generated by the data writing sub-circuit 204 to the first driving sub-circuit $\mathbf{201}_1$ under control of the writing control signal SW_1. The second switching sub-circuit may receive a writing control signal SW_2 (a second writing control signal) and provide the compensated data signal generated by the data writing sub-circuit 204 to the second driving sub-circuit $\mathbf{201}_2$ under control of the writing control signal SW_2.

In FIG. 2, the fourth transistor T4_1 has a gate electrically coupled to receive the writing control signal SW_1 (the first writing control signal), a first electrode electrically coupled to the gate and the first electrode of the second transistor T2, and a second electrode electrically coupled to the first driving sub-circuit $\mathbf{201}_1$. The fourth transistor T4_2 has a gate electrically coupled to receive the writing control signal SW_2 (the second writing control signal), a first electrode electrically coupled to the gate and the first electrode of the second transistor T2, and a second electrode electrically coupled to the second driving sub-circuit $\mathbf{201}_2$.

As shown in FIG. 2, the fourth transistor T4_1 may be turned on under control of the writing control signal SW_1, and the fourth transistor T4_2 may be turned on under control of the writing control signal SW_2, so as to turn on respective electrical connection paths from the data writing sub-circuit 204 to the first driving sub-circuit $\mathbf{201}_1$ and the second driving sub-circuit $\mathbf{201}_2$ to write the compensated data signals into the first driving sub-circuit $\mathbf{201}_1$ and the second driving sub-circuit $\mathbf{201}_2$ respectively.

Likewise, the fourth transistors T4_1 and T4_2 are shown as P-type transistors, but the present disclosure is not limited thereto. In other examples, the fourth transistors T4_1 and T4_2 may also be N-type transistors. In this case, voltages of the writing control signals SW_1 and SW_2 may be changed accordingly to implement the functions of the writing control sub-circuit 203.

As shown in FIG. 2, the first driving sub-circuit $\mathbf{201}_1$ may comprise a driving transistor (a fifth transistor) DTFT_1 and a storage capacitor C_1, and the second driving sub-circuit $\mathbf{201}_2$ may comprise a driving transistor (a fifth transistor) DTFT_2 and a storage capacitor C_2. The two driving sub-circuits may have the same structure. The driving transistor DTFT_1 and the driving transistor DTFT_2 may have substantially the same threshold voltage and substantially the same temperature drift amount of the threshold voltage. In some embodiments, the driving transistor DTFT_1 and the driving transistor DTFT_2 may be the same.

By taking the first driving sub-circuit $\mathbf{201}_1$ as an example, the driving transistor DTFT_1 has a gate electrically coupled to the second electrode of the fourth transistor T4_1, a first electrode (drain) electrically coupled to the first light-emitting control sub-circuit $202_1$, and a second electrode (source) electrically coupled to receive a first voltage VDD. The storage capacitor C_1 has a first terminal electrically coupled to the second electrode of the fourth transistor T4_1, and a second terminal electrically coupled to receive the first voltage VDD.

As shown in FIG. 2, the first driving sub-circuit $201_1$ may store the compensated data signal (obtained by, for example, adding the first compensation signal (voltage) to the first data signal (voltage)) which is written through the writing control sub-circuit 203 and the data writing sub-circuit 204 in the storage capacitor C_1. The driving transistor DTFT_1 may generate current (driving current) which causes the light-emitting element $OLED_1$ to emit light under control of a voltage (the compensated data signal) applied to the gate thereof, as shown in the following formula:

$$I_1=K_1\cdot(V_{GS1}-V_{th1})^2$$

wherein K1 represents a parameter related to a process and design of the driving transistor DTFT_1, and may be regarded as a constant for a specific transistor; $V_{GS1}$ represents a voltage applied between the gate and the source of the driving transistor DTFT_1, and $V_{GS1}=V_{G1}-V_{DD}$ if $V_{G1}$ represents the voltage applied to the gate of the driving transistor DTFT_1 and $V_{DD}$ represents a voltage value of the first voltage VDD; $V_{th1}$ represents a threshold voltage of the driving transistor DTFT_1, and is a negative value for a P-type driving transistor DTFT_1, and $I_1$ is resulting current.

The second driving sub-circuit $201_2$ may have the same structure as that of the first driving sub-circuit $201_1$. The driving transistor DTFT_2 may generate current $I_2=K_2\cdot(V_{GS2}-V_{th2})^2$ which causes the light-emitting element $OLED_2$ to emit light under control of a voltage applied to the gate thereof, wherein $K_2$ represents a parameter related to a process and design of the driving transistor DTFT_2, and may be regarded as a constant for a specific transistor; $V_{GS2}$ represents a voltage applied between the gate and the source of the driving transistor DTFT_2, and $V_{GS2}=V_{G2}-V_{DD}$ if $V_{G2}$ represents the voltage applied to the gate of the driving transistor DTFT_2; $V_{th2}$ represents a threshold voltage of the driving transistor DTFT_2, and is a negative value for a P-type driving transistor DTFT_2.

Likewise, the driving transistors DTFT_1 and DTFT_2 are shown as P-type transistors, but the present disclosure is not limited thereto. In other examples, the driving transistors DTFT_1 and DTFT_2 may also be N-type transistors.

As shown in FIG. 2, the first light-emitting control sub-circuit $202_1$ comprises a sixth transistor T6_1, the second light-emitting control sub-circuit $202_2$ comprises a sixth transistor T6_2, and the two light-emitting control sub-circuits have the same structure.

By taking the first light-emitting control sub-circuit $202_1$ as an example, the sixth transistor T6_1 has a gate electrically coupled to receive a light-emitting control signal EM_1 (a first light-emitting control signal), a first electrode electrically coupled to the first terminal of the light-emitting element $OLED_1$, and a second electrode electrically coupled to the drain of the driving transistor DTFT_1. The sixth transistor T6_1 may be turned on under control of the light-emitting control signal EM_1 applied to the gate thereof, so as to provide the current generated by the first driving sub-circuit $201_1$ to the light-emitting element $OLED_1$.

A structure and a function of the second light-emitting control sub-circuit $202_2$ are the same as those of the first light-emitting control sub-circuit $202_1$, and will not be described in detail here.

Likewise, the sixth transistors T6_1 and T6_2 are shown as P-type transistors, but the present disclosure is not limited thereto. In other examples, the sixth transistors T6_1 and T6_2 may also be N-type transistors. In a case of N-type transistors, functions of the first light-emitting control sub-circuit $202_1$ and the second light-emitting control sub-circuit $202_2$ are realized by changing voltages of the light-emitting control signal EM_1 (the first light-emitting control signal) and the light-emitting control signal EM_2 (the second light-emitting control signal) accordingly.

Different types of transistors generally have different threshold voltages. In addition, since a threshold voltage of a transistor may change with temperature, that is, a drift of the threshold voltage occurs, even for the same transistor, when an application environment changes, non-uniform display may occur due to the drift of the threshold voltage.

In the embodiment of the present disclosure, the threshold voltages of the driving transistors DTFT_1 and DTFT_2 are compensated by providing the common second transistor T2 in the data writing sub-circuit 204, wherein the second transistor T2 has substantially the same electrical characteristics as those of the driving transistors DTFT_1 and DTFT_2.

According to an embodiment, differences between a threshold voltage of the second transistor T2 and the threshold voltages of the driving transistors DTFT_1 and DTFT_2 may be within a preset first threshold range, so that the threshold voltage of the second transistor T2 may be considered as substantially equal to those of the driving transistors DTFT_1 and DTFT_2. In addition, differences between a temperature drift amount of the threshold voltage of the second transistor T2 and temperature drift amounts of the threshold voltages of the driving transistors DTFT_1 and DTFT_2 may also be within a preset second threshold range, so that the temperature drift amount of the threshold voltage of the second transistor T2 may be considered as substantially equal to those of the driving transistors DTFT_1 and DTFT_2.

For example, the threshold voltages of the second transistor T2 and the driving transistors DTFT_1 and DTFT_2 are represented by $V'_{th}$, $V_{th1}$ and $V_{th2}$ respectively. The compensation signals (obtained by adding the threshold voltage $V'_{th}$ to voltages of the data signal) comprising the threshold voltage V'th of T2 are written into the gate of the driving transistor DTFT_1 in the first driving sub-circuit $201_1$ and the gate of the driving transistor DTFT_2 in the second driving sub-circuit $201_2$ respectively through the writing control sub-circuit 203 and the data writing sub-circuit 204. In this way, in a case where the threshold voltage of the second transistor T2 is substantially equal to the threshold voltages of the driving transistors DTFT_1 and DTFT_2, it may be considered that $V'_{th}=V_{th1}=V_{th2}$, and the influence of the threshold voltages $V_{th1}$ and $V_{th2}$ of the driving transistors DTFT_1 and DTFT_2 are eliminated from the formula $I_1=K_1\cdot(V_{GS1}-V_{th1})^2$ of current which is generated by the driving transistor DTFT_1 and the formula $I_2=K_2\cdot(V_{GS2}-V_{th2})^2$ of current which is generated by the driving transistor DTFT_2.

According to an embodiment, an absolute value of the difference between the threshold voltage of the second transistor T2 and the threshold voltages of the driving transistors DTFT_1 and DTFT_2 may be less than or equal to 0.01V. According to an embodiment, an absolute value of the difference between the temperature drift amount of the threshold voltage of the second transistor T2 and the temperature drift amounts of the threshold voltages of the driving transistors DTFT_1 and DTFT_2 may be less than or equal to 0.01V.

According to an embodiment, transistors having substantially the same electrical characteristics may be manufactured using the following method. For example, in some embodiments, the second transistor T2 may be arranged closer to the driving transistors DTFT_1 and DTFT_2, for example, the driving transistors DTFT_1 and DTFT_2 are arranged in adjacent columns, and the second transistor T2 is arranged between the driving transistor DTFT_1 and DTFT_2. In some embodiments, the second transistor T2 and the driving transistors DTFT_1 and DTFT_2 may be processed through processes such as environmental parameter testing and aging experiment debugging etc. In some embodiments, transistors having substantially the same electrical characteristics may be obtained by improving manufacturing processes of the second transistor T2 and the driving transistors DTFT_1 and DTFT_2. However, the present disclosure is not limited to the above embodiments, and any method which may enable the electrical characteristics of the second transistor T2 to be substantially the same as those of the driving transistors DTFT_1 and DTFT_2 may be adopted. In addition, the second transistor T2 and the driving transistors DTFT_1 and DTFT_2 according to the embodiment of the present disclosure have substantially the same electrical characteristics, but may have different sizes and shapes.

According to an embodiment of the present disclosure, the threshold voltages and the temperature shift amounts of the threshold voltages of the driving transistors DTFT_1 and DTFT_2 included in the first driving sub-circuit $201_1$ and the second driving sub-circuit $201_2$ may be compensated by the common data writing sub-circuit 204 comprising the second transistor T2, which reduces the size of the circuit while improving the display effect, and provides the possibility for improving the display resolution.

FIG. 3 schematically illustrates another exemplary circuit structure of a pixel driving circuit according to an embodiment of the present disclosure.

As shown in FIG. 3, the pixel driving circuit 300 comprises a first driving sub-circuit $301_1$ and a second driving sub-circuit $301_2$, a first light-emitting control sub-circuit $302_1$ and a second light-emitting control sub-circuit $302_2$, a writing control sub-circuit 303, and a data writing sub-circuit 304. In addition, the first driving sub-circuit $301_1$ and the second driving sub-circuit $301_2$, the writing control sub-circuit 303, and the data writing sub-circuit 304 may have the same structures as those of the first driving sub-circuit $201_1$ and the second driving sub-circuit $201_2$, the writing control sub-circuit 203 and the data writing sub-circuit 204 of the pixel driving circuit 200, and will not be described in detail here.

As shown in FIG. 3, the first light-emitting control sub-circuit $302_1$ of the pixel driving circuit 300 comprises a sixth transistor T6_1 and a seventh transistor T7_1, and the second light-emitting control sub-circuit $302_2$ of the pixel driving circuit 300 comprises a sixth transistor T6_2 and a seventh transistor T7_2. The sixth transistors T6_1 and T6_2 may be implemented with reference to the sixth transistor included in the first light-emitting control sub-circuit $202_1$ of the pixel driving circuit 200 shown in FIG. 2. The seventh transistor T7_1 has a gate electrically coupled to receive a second reset signal REST2_1, a first electrode electrically coupled to receive a second initialization signal $V'_{init}$, and a second electrode electrically coupled to the first terminal of the light-emitting element $OLED_1$.

The seventh transistor T7_1 may be turned on under control of the second reset signal REST2_1 applied to the gate thereof to apply the second initialization signal $V'_{init}$ to the first terminal of the light-emitting element $OLED_1$ to set the light-emitting element $OLED_1$ to be in a predetermined state, which may effectively reduce afterimages during display.

The seventh transistor T7_2 may be coupled in a manner similar to that of the seventh transistor T7_1. In FIG. 3, the gate of the seventh transistor T7_2 is shown as being electrically coupled to receive the second reset signal REST2_2. The second reset signals REST2_1 and REST2_2 represent second reset signals applied to the first light-emitting control sub-circuit $302_1$ and the second light-emitting control sub-circuit $302_2$ respectively, and may have the same or different timings.

According to the embodiment of the present disclosure, the light-emitting elements $OLED_1$ and $OLED_2$ may be turned off faster by resetting the light-emitting elements $OLED_1$ and $OLED_2$, which reduces the afterimages during the display while compensating for the threshold voltages of the driving transistors DTFT_1 and DTFT_2 and the temperature drift amounts of the threshold voltages, thereby further improving the display effect.

FIG. 4 schematically illustrates still another exemplary circuit structure of a pixel driving circuit according to an embodiment of the present disclosure. Compared with the pixel driving circuit 300 shown in FIG. 3, eighth transistors T8_1 and T8_2 are further added in the first light-emitting control sub-circuit $302_1$ and the second light-emitting control sub-circuit $302_2$ respectively.

As shown in FIG. 4, the eighth transistor T8_1 has a gate electrically coupled to receive another light-emitting control signal EM2_1, a first electrode electrically coupled to the source of the driving transistor DTFT_1, and a second electrode electrically coupled to receive the first voltage VDD. The eighth transistor T8_2 has a gate electrically coupled to receive another light-emitting control signal EM2_2, a first electrode electrically coupled to the source of the driving transistor DTFT_2, and a second electrode electrically coupled to receive the first voltage VDD. The eighth transistors T8_1 and T8_2 may be turned off during a non-light-emitting phase, so as to prevent the driving transistors DTFT_1 and DTFT_2 from providing driving current to the light-emitting elements during the non-light-emitting phase, which may further improve the display effect.

FIG. 5 schematically illustrates a block diagram of a display panel according to an embodiment of the present disclosure.

As shown in FIG. 5, the display panel 500 comprises a plurality of pixel units (as shown by dashed blocks, only one pixel unit is labeled in FIG. 5 for simplicity) arranged in an array. Each of the pixel units comprises a pixel driving circuit 502 and at least two light-emitting elements 501 (two light-emitting elements are shown in FIG. 5). The at least two light-emitting elements 501 are electrically coupled in one-to-one correspondence with at least two driving sub-circuits of the pixel driving circuit. The pixel driving circuits 502 may be implemented by the pixel driving circuits in any of the above embodiments.

In FIG. 5, the pixel units are arranged in an M×N array, wherein M and N are both integers greater than 1, and pixel driving circuits of an $i^{th}$ row of pixel units are coupled to receive an $i^{th}$ scanning signal $V_{scan}(i)$, wherein i is an integer, and $1 \le i \le M$, and pixel driving circuits of a $j^{th}$ column of pixel units are coupled to receive a $j^{th}$ data signal $V_{data}(j)$, wherein j is an integer and $1 \leq j \leq N$.

In a case where the pixel driving circuit 502 has any of the structures described above with reference to FIGS. 2 to 4, in the pixel driving circuits of the $i^{th}$ row of pixel units, each of first light-emitting control sub-circuits $\mathbf{302}_1$ may be coupled to a first light-emitting control signal EM_1(*i*) for the $i^{th}$ row of pixel units, each of second light-emitting control sub-circuits $\mathbf{302}_1$ may be coupled to a second light-emitting control signal EM_2(*i*) for the $i^{th}$ row of pixel units, each of first switching sub-circuits (for example, the gate of the fourth transistor T4_1) may be coupled to receive a first writing control signal SW_1(*i*) for the $i^{th}$ row of pixel units, and each of second switching sub-circuits (for example, the gate of the fourth transistor T4_2) may be coupled to receive a second writing control signal SW_2(*i*) for the $i^{th}$ row of pixel units.

As shown in FIG. 5, the display panel 500 comprises a plurality of scanning lines $SL_1$, $SL_2$, $SL_3$, . . . , $SL_M$, a plurality of data lines $DL_1$, $DL_2$, . . . , $DL_N$, a plurality of light-emitting elements 501, and a plurality of pixel driving circuits 502.

The plurality of light-emitting elements 501 are arranged in a matrix comprising rows and columns. The plurality of scanning lines $SL_1$, $SL_2$, $SL_3$, . . . , $SL_M$ are arranged in correspondence with respective rows of light-emitting elements. The plurality of data lines $DL_1$, $DL_2$, . . . , $DL_N$ intersect with the plurality of scanning lines $SL_1$, $SL_2$, $SL_3$, . . . , $SL_M$, and a data line $DL_j$ is arranged between a $(2j-1)^{th}$ column of light-emitting elements 501 and a $(2j)^{th}$ column of light-emitting elements 501. The plurality of pixel driving circuits 502 according to the above embodiments are arranged at respective positions where the plurality of scanning lines intersect the plurality of data lines, and data writing sub-circuits of the pixel driving circuits 502 are electrically coupled to scanning lines and data lines corresponding to the intersection positions to receive scanning signals and data signals respectively.

In the display panel according to the embodiment of the present disclosure, one data line is shared between two adjacent columns of light-emitting elements, which may significantly reduce wiring of the data lines while compensating for the threshold voltages of the transistors, thereby reducing a scale of the circuit.

FIG. 6 schematically illustrates a block diagram of a display apparatus according to an embodiment of the present disclosure. As shown in FIG. 6, the display apparatus 600 according to the embodiment of the present disclosure comprises the display panel 601 according to the embodiment of the present disclosure. The display apparatus 600 according to the embodiment of the present disclosure may be any product or component having a display function, such as an electronic paper, a mobile phone, a tablet computer, a television, a display, a notebook computer, a digital photo frame, a navigator, etc.

FIG. 7 schematically illustrates a flowchart of a driving method according to an embodiment of the present disclosure, and FIGS. 8A and 8B schematically illustrate timing diagrams of the driving method according to an embodiment of the present disclosure. The driving method according to the embodiment of the present disclosure will be described below with reference to FIGS. 7, 8A, and 8B based on the pixel driving circuit 200 of the embodiment shown in FIG. 2.

As shown in FIG. 7, the driving method 700 comprises the following steps S710 to S740.

In step S710, during a first period, the data writing sub-circuit of the pixel driving circuit compensates for a $k^{th}$ data signal and writes the compensated $k^{th}$ data signal (for example, a first compensation signal and a first data signal) into a $k^{th}$ driving sub-circuit (for example, a first driving sub-circuit) of the pixel driving circuit under control of the writing control sub-circuit, wherein k is an integer, and $1 \leq k \leq K-1$, where K represents a number of driving sub-circuits of the pixel driving circuit, and K is an integer greater than 1. The compensated data signal provided to the $k^{th}$ driving sub-circuit may be used to drive a $k^{th}$ light-emitting element in a pixel unit where the pixel driving circuit is located. For example, for a pixel unit located in an $i^{th}$ row and a $j^{th}$ column, if the pixel unit comprises two light-emitting elements, a first one of the two light-emitting elements is located in an $i^{th}$ row and a $(2j-1)^{th}$ column in an array formed by light-emitting elements on a display panel, and a second one of the two light-emitting elements is located in the $i^{th}$ row and a $(2j)^{th}$ column in the array, and vice versa.

In step S720, during a second period, a $k^{th}$ light-emitting control sub-circuit outputs $k^{th}$ driving current generated by the $k^{th}$ driving sub-circuit. For example, the $k^{th}$ driving sub-circuit may generate driving current (the $k^{th}$ driving current) for causing the $k^{th}$ light-emitting element to emit light using the compensated $k^{th}$ data signal (for example, the first compensation signal and the first data signal), and the $k^{th}$ light-emitting control sub-circuit outputs the $k^{th}$ driving current to the $k^{th}$ light-emitting element.

In step S730, during a third period, the data writing sub-circuit of the pixel driving circuit compensates for a $(k+1)^{th}$ data signal and writes the compensated $(k+1)^{th}$ data signal (for example, a second compensation signal and a second data signal for a second light-emitting element of the pixel unit) into a (k+1)th driving sub-circuit (for example, a second driving sub-circuit) of the pixel driving circuit under control of the writing control sub-circuit.

In step S740, during a fourth period, a $(k+1)^{th}$ light-emitting control sub-circuit outputs $(k+1)^{th}$ driving current generated by the $(k+1)^{th}$ driving sub-circuit. For example, the second driving sub-circuit generates driving current for causing the second light-emitting element to emit light using the second compensation signal and the second data signal, and the second light-emitting control sub-circuit outputs the second driving current to the second light-emitting element.

Although steps of the method have been described above in a specific order, the embodiments of the present disclosure are not limited thereto. For example, steps S720 and S740 may be performed at the same time after step S730 is performed, that is, the compensated data signals may be written into the $k^{th}$ driving sub-circuit and the $(k+1)^{th}$ driving sub-circuit sequentially, and then the $k^{th}$ driving signal and the $(k+1)^{th}$ driving signal are output at the same time to light up the $k^{th}$ light-emitting unit and the $(k+1)^{th}$ light-emitting unit at the same time.

The above steps will be described in detail below with reference to the exemplary structure of FIG. 2.

As shown in FIGS. 2 and 8A, the first period may comprise an initialization period t1 and a data writing period t2. During the initialization period t1, the first reset signal REST1 at a low level and the writing control signal SW_1 at a low level are provided. When the first reset signal REST1 is at a low level, the first transistor T1 is turned on, and the first initialization signal $V_{init}$ is applied to the gate of the second transistor T2 to ensure that the second transistor T2 may be turned on. When the writing control signal SW_1 is at a low level, the fourth transistor T4_1 is turned on, so that an electrical connection path between the data writing sub-circuit 204 and the first driving sub-circuit $\mathbf{201}_1$ is turned on.

During the initialization period t1, the scanning signal $V_{scan}$ is at a high level, and therefore the third transistor T3 is turned off. The writing control signal SW_2 is at a high level, and therefore the fourth transistor T4_2 is turned off, and an electrical connection path between the data writing sub-circuit 204 and the second driving sub-circuit $\mathbf{201}_2$ is turned off. The light-emitting control signal EM_1 is at a high level, so that the sixth transistor T6_1 is turned off, and thereby the light-emitting element $OLED_1$ stops emitting light. The light-emitting control signal EM_2 is at a low level, that is, in a process of writing data into the light-emitting element $OLED_1$, the light-emitting element $OLED_2$ may display normally. When data signals and compensation signals are not written, $OLED_1$ and $OLED_2$ are generally in a light-emitting state, that is, the light-emitting control signals EM_1 and EM_2 are at a low level. Therefore, before a data signal and a compensation signal are written, a light-emitting state of a light-emitting element into which the data is to be written may be disabled. As shown in FIG. 8A, during a period of time before the initialization period t1, the light-emitting control signal EM_1 is set to a high level, so that the light-emitting element $OLED_1$ stops emitting light.

Next, during the data writing period t2, the writing control signal SW_1 is maintained at a low level, and therefore the fourth transistor T4_1 is maintained to be turned on. At the same time, the second transistor T2 is maintained to be turned on under control of the first initialization signal $V_{init}$. The scanning signal $V_{scan}$ at a low level and a valid first data signal $V_{data1}$ are provided. When the scanning signal $V_{scan}$ is at a low level, the third transistor T3 is turned on. In a case where both the second transistor T2 and the third transistor T3 are turned on, the first data signal $V_{data1}$ charges the second terminal (that is, the gate of the driving transistor DTFT_1) of the storage capacitor C_1 through the third transistor T3, the second transistor T2, and the fourth transistor T4_1. The charging process does not end until a gate voltage $V_{G1}$ of the driving transistor DTFT_1 is equal to $V_{data1}+V'_{th}$, wherein $V'_{th}$ represents a threshold voltage of the second transistor T2. Thereby, both the first data signal $V_{data1}$ and the first compensation signal $V'_{th}$ (for example, a compensated data signal having a voltage of $V_{data1}+V'_{th}$) are written into the gate of the driving transistor DTFT_1.

During the data writing period t2, the first reset signal REST1 is at a high level, and therefore the first transistor T1 is turned off. The light-emitting control signal EM_1 and the writing control signal SW_2 are maintained at a high level, the light-emitting control signal EM_2 is maintained at a low level, and therefore states of the sixth transistor T6_1, the fourth transistor T4_2, and the sixth transistor T6_2 are maintained to be unchanged.

Next, during a period t3 (that is, a second period), the scanning signal $V_{scan}$ is set to a high level to stop writing data, and the writing control signal SW_1 is set to a high level to turn off the electrical connection path between the data writing sub-circuit 204 and the first driving sub-circuit $\mathbf{201}_1$ and the light-emitting control signal EM_1 at a low level is provided to cause the light-emitting element $OLED_1$ to emit light using the written first data signal $V_{data1}$ and the written first compensation signal $V'_{th}$. Current generated by the driving transistor DTFT_1 is $11=K_1\cdot(V_{GS1}-V_{th1})^2$, wherein $V_{GS1}=V_{G1}-V_{DD}=V_{data1}+V'_{th}-V_{DD}$, and $V_{th1}$ is the threshold voltage of DTFT_1, and is a negative value. Since $V_{th1}$ may be set to be equal to V'th, the current generated by the driving transistor DTFT_1 is $I_1=K_1\cdot(V_{data1}-V_{DD})^2$. That is, the resulting current has nothing to do with the threshold voltage of the driving transistor DTFT_1, and has nothing to do with the temperature drift of the threshold voltage of DTFT_1. Thereby, the electrical compensation is completed.

The third period may comprise an initialization period t4 and a data writing period t5. During the third period, the light-emitting control signal EM_1 is at a low level, so that in a process of writing data into the light-emitting element $OLED_2$, the light-emitting element $OLED_1$ may display normally.

During the initialization period t4, the first reset signal REST1 at a low level and the writing control signal SW_2 at a low level are provided. When the first reset signal REST1 is at a low level, the first transistor T1 is turned on, and the first initialization signal $V_{init}$ is applied to the gate of the second transistor T2 to ensure that the second transistor T2 may be turned on. When the writing control signal SW_2 is at a low level, the fourth transistor T4_2 is turned on, so that the electrical connection path between the data writing sub-circuit 204 and the second driving sub-circuit $\mathbf{201}_2$ is turned on.

During the initialization period t4, the scanning signal $V_{scan}$ is at a high level, and therefore the third transistor T3 is turned off. The writing control signal SW_1 is at a high level, and therefore the fourth transistor T4_1 is turned off, and the electrical connection path between the data writing sub-circuit 204 and the first driving sub-circuit $\mathbf{201}_1$ is turned off. The light-emitting control signal EM_2 is at a high level, so that the light-emitting element $OLED_2$ stops emitting light. When the data signals and the compensation signals are not written, the light-emitting elements $OLED_1$ and $OLED_2$ are generally in a light-emitting state, that is, the light-emitting control signals EM_1 and EM_2 are at a low level. Therefore, before a data signal and a compensation signal are written, a light-emitting state of a light-emitting element into which the data is to be written may be disabled. As shown in FIG. 8A, before the initialization period t4, the light-emitting control signal EM_2 is set to a high level.

Next, during a data writing period t5, the writing control signal SW_2 is maintained at a low level, and therefore the fourth transistor T4_2 is maintained to be turned on. The second transistor T2 is maintained to be turned on under control of the first initialization signal $V_{init}$. The scanning signal $V_{scan}$ at a low level and a valid second data signal $V_{data2}$ are provided. When the scanning signal $V_{scan}$ is at a low level, the third transistor T3 is turned on. In a case where the second transistor T2 and the third transistor T3 are both turned on, the second data signal $V_{data2}$ charges the second terminal (that is, the gate of the driving transistor DTFT_2) of the storage capacitor C_2 through the third transistor T3, the second transistor T2, and the fourth transistor T4_2. The charging process does not end until a gate voltage $V_{G2}$ of the driving transistor DTFT_2 is equal to $V_{data2}+V'_{th}$, wherein $V'_{th}$ represents a threshold voltage of the second transistor T2. Thereby, both the second data signal $V_{data2}$ and the second compensation signal $V'_{th}$ are written into the gate of the driving transistor DTFT_2.

During the data writing period t5, the first reset signal REST1 is at a low level, and therefore the first transistor T1 is turned off. The light-emitting control signal EM_2 and the writing control signal SW_1 are maintained at a high level, the light-emitting control signal EM_1 is maintained at a low level, and therefore states of the sixth transistor T6_2, the fourth transistor T4_1, and the sixth transistor T6_1 are maintained to be unchanged.

Next, during a period t6 (that is, a fourth period), the scanning signal $V_{scan}$ is set to a high level to stop writing data, the writing control signal SW_2 is set to a high level to turn off the electrical connection path between the data writing sub-circuit 204 and the second driving sub-circuit $\mathbf{201}_2$, and the light-emitting control signal EM_2 at a low level is provided to cause the light-emitting element $OLED_2$ to emit light using the written second data signal $V_{data2}$ and the written second compensation signal $V'_{th}$. Current generated by the driving transistor DTFT_2 is $I_2=K_2\cdot(V_{GS2}-V_{th2})^2$, wherein $V_{GS2}=V_{G2}-V_{DD}=V_{data2}+V'_{th}-V_{DD}$, and $V_{th2}$ is a threshold voltage of DTFT_2, and is a negative value. Since $V_{th2}$ may be set to $V'_{th}$, the current generated by the driving transistor DTFT_2 is $I_2=K_2\cdot(V_{data2}-V_{DD})^2$. That is, the resulting current has nothing to do with the threshold voltage of the driving transistor DTFT_2, and has nothing to do with the temperature drift of the threshold voltage of DTFT_2. Thereby, the electrical compensation is completed.

In some embodiments, the period t3 and the period t4 may be combined, that is, the data writing for the light-emitting element $OLED_2$ may be initialized while the light-emitting element $OLED_1$ is caused to emit light using the written first data signal $V_{data1}$ and the written first compensation signal V'th, as shown in FIG. 8B. The electrical connection path between the data writing sub-circuit 204 and the first driving sub-circuit $\mathbf{201}_1$ may be turned off by the writing control signal SW_1 before the data writing for the light-emitting element $OLED_2$ is initialized, so as to prevent the first driving sub-circuit $\mathbf{201}_1$ and the second driving sub-circuit $\mathbf{201}_2$ from being electrically coupled to the data writing sub-circuit 204 at the same time. Specific operations of the period t3 (t4) may be known with reference to FIG. 8B and the above related description of the period t3 and the period t4, and will not be described in detail here.

It should be illustrated that, in the above description, the technical solutions according to the embodiments of the present disclosure are shown by way of example only, but it does not mean that the embodiments of the present disclosure are limited to the above steps and structures. Where possible, steps and structures may be adjusted and selected as needed. Therefore, certain steps and units are not elements necessary to implement the general inventive concept of the embodiments of the present disclosure.

The present disclosure has been described so far in connection with the preferred embodiments. It should be understood that those skilled in the art may make various other changes, substitutions, and additions without departing from the spirit and scope of the embodiments of the present disclosure. Therefore, the scope of the embodiments of the present disclosure is not limited to the specific embodiments described above, but should be defined by the appended claims.

We claim:

1. A pixel driving circuit, comprising:

at least two driving sub-circuits, each configured to generate driving current based on a compensated data signal;

at least two light-emitting control sub-circuits coupled to the at least two driving sub-circuits respectively, each of the at least two light-emitting control sub-circuits is configured to output driving current generated by one of the at least two driving sub-circuits coupled thereto;

a writing control sub-circuit electrically coupled to the at least two driving sub-circuits and a data writing sub-circuit; and the data writing sub-circuit configured to compensate for a data signal and write the compensated data signal into the at least two driving sub-circuits sequentially under control of the writing control sub-circuit, wherein the writing control sub-circuit comprises at least two switching sub-circuits electrically coupled to the at least two driving sub-circuits respectively, each switching sub-circuit is configured to receive a writing control signal and write the compensated data signal generated by the data writing sub-circuit into one of the at least two driving sub-circuit coupled thereto under control of the writing control signal, wherein each of the at least two driving sub-circuits comprises:a fifth transistor having a gate electrically coupled to one of the at least two switching sub-circuits, a first electrode electrically coupled to one of the at least two light-emitting control sub-circuits, and a second electrode electrically coupled to receive a first voltage; and a storage capacitor having a first terminal electrically coupled to the gate of the fifth transistor, and a second terminal electrically coupled to receive the first voltage, wherein each of the at least two light-emitting control sub-circuits comprises: a sixth transistor having a gate electrically coupled to receive a light-emitting control signal, a first electrode electrically coupled to output the driving current, and a second electrode electrically coupled to the first electrode of the fifth transistor; and a seventh transistor having a gate electrically couple to receive a second reset signal, a first electrode electrically coupled to receive a second initialization signal, and a second electrode electrically coupled to the first electrode of the sixth transistor.

2. The pixel driving circuit according to claim 1, wherein the data writing sub-circuit comprises:

a first transistor having a gate electrically coupled to receive a first reset signal, a first electrode electrically coupled to receive a first initialization signal, and a second electrode electrically coupled to a gate of a second transistor and a first electrode of the second transistor;

the second transistor having a second electrode electrically coupled to a first electrode of a third transistor; and the third transistor having a gate electrically coupled to receive a scanning signal, and a second electrode electrically coupled to receive the data signal.

3. The pixel driving circuit according to claim 1, wherein each of the at least two switching sub-circuits comprises:

a fourth transistor having a gate electrically coupled to receive the writing control signal, a first electrode electrically coupled to the data writing sub-circuit to receive the compensated data signal, and a second electrode electrically coupled to one of the at least two driving sub-circuits.

4. The pixel driving circuit according to claim 2, wherein a difference between a threshold voltage of the second transistor and a threshold voltage of a fifth transistor in each driving sub-circuit which is used as a driving transistor is within a preset first threshold range.

5. The pixel driving circuit according to claim 4, wherein a difference between a temperature drift amount of the threshold voltage of the second transistor and a temperature drift amount of the threshold voltage of the fifth transistor in each driving sub-circuit is within a preset second threshold range.

6. The pixel driving circuit according to claim 4, wherein an absolute value of the difference between the threshold voltage of the second transistor and the threshold voltage of the fifth transistor is less than or equal to 0.01V.

7. The pixel driving circuit according to claim 5, wherein an absolute value of the difference between the temperature drift amount of the threshold voltage of the second transistor and the temperature drift amount of the threshold voltage of the fifth transistor is equal to or less than 0.01V.

8. The pixel driving circuit according to claim 1, wherein the at least two driving sub-circuits comprise a first driving sub-circuit and a second driving sub-circuit, wherein the first driving sub-circuit is configured to generate first driving current based on the compensated data signal, and the second driving sub-circuit is configured to generate second driving current based on the compensated data signal; and the at least two light-emitting control sub-circuits comprise a first light-emitting control sub-circuit and a second light-emitting control sub-circuit, wherein the first light-emitting control sub-circuit is coupled to the first driving sub-circuit and is configured to output the first driving current generated by the first driving sub-circuit under control of a first light-emitting control signal, and the second light-emitting control sub-circuit is coupled to the second driving sub-circuit, and is configured to output the second driving current generated by the second driving sub-circuit under control of a second light-emitting control signal.

9. The pixel driving circuit according to claim 8, wherein the writing control sub-circuit comprises:

a first switching sub-circuit electrically coupled between the first driving sub-circuit and the data writing sub-circuit, and configured to receive a first writing control signal, and provide the compensated data signal generated by the data writing sub-circuit to the first driving sub-circuit under control of the first writing control signal; and a second switching sub-circuit electrically coupled between the second driving sub-circuit and the data writing sub-circuit, and configured to receive a second writing control signal, and provide the compensated data signal generated by the data writing sub-circuit to the second driving sub-circuit under control of the second writing control signal.

10. The pixel driving circuit according to claim 8, wherein the data writing sub-circuit is configured to compensate for a first data signal and write the compensated first data signal into the first driving sub-circuit, and compensate for a second data signal and write the compensated second data signal into the second driving sub-circuit, under control of the writing control sub-circuit.

11. A display panel comprising a plurality of pixel units arranged in an array, each pixel unit comprising:

the pixel driving circuit according to claim 1; and at least two light-emitting elements electrically coupled in one-to-one correspondence with the at least two driving sub-circuits of the pixel driving circuit.

12. The display panel according to claim 11, wherein the array is an M×N array, wherein M and N are both integers greater than 1;

pixel driving circuits of an $i^{th}$ row of pixel units are coupled to receive an $i^{th}$ scanning signal, wherein i is an integer, and $1 \le i \le M$; and pixel driving circuits of a $j^{th}$ column of pixel units are coupled to receive a $j^{th}$ data signal, wherein j is an integer, and $1 \le j \le N$.

13. A method for driving the pixel driving circuit according to claim 1, comprising:

during a first period, compensating for, by the data writing sub-circuit, a $k^{th}$ data signal and writing the compensated $k^{th}$ data signal into a $k^{th}$ driving sub-circuit of the pixel driving circuit under control of the writing control sub-circuit;

during a second period, outputting, by a $k^{th}$ light-emitting control sub-circuit, $k^{th}$ driving current generated by the $k^{th}$ driving sub-circuit;

during a third period, compensating for, by the data writing sub-circuit, a $(k+1)^{th}$ data signal and writing the compensated $(k+1)^{th}$ data signal into a $(k+1)^{th}$ driving sub-circuit of the pixel driving circuit under control of the writing control sub-circuit; and during a fourth period, outputting, by a $(k+1)^{th}$ light-emitting control sub-circuit, $(k+1)^{th}$ driving current generated by the $(k+1)^{th}$ driving sub-circuit, wherein k is an integer, and $1 \le k \le K-1$, where K represents a number of driving sub-circuits of the pixel driving circuit, and is an integer greater than 1.

14. A method for driving the display panel according to claim 11, comprising: for each pixel unit, during a first period, writing, by a data writing sub-circuit of a pixel driving circuit of the pixel unit, a compensated data signal for a $k^{th}$ light-emitting element of the pixel unit into a $k^{th}$ driving sub-circuit of the pixel driving circuit;

during a second period, causing the $k^{th}$ light-emitting element to emit light using the compensated data signal;

during a third period, writing, by the data writing sub-circuit of the pixel driving circuit, a compensated data signal for a $(k+1)^{th}$ light-emitting element of the pixel unit into a $(k+1)^{th}$ driving sub-circuit of the pixel driving circuit; and during a fourth period, causing the $(k+1)^{th}$ light-emitting element to emit light using the compensated data signal, wherein k is an integer and $1 \le k \le K-1$, where K represents a number of driving sub-circuits of the pixel driving circuit in the pixel unit, and is an integer greater than 1.

* * * * *